US008569640B2

(12) United States Patent
Yamada et al.

(10) Patent No.: US 8,569,640 B2
(45) Date of Patent: Oct. 29, 2013

(54) KEY SWITCH STRUCTURE

(75) Inventors: Shigeru Yamada, Gumma (JP); Yasushi Takagi, Gumma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 365 days.

(21) Appl. No.: 12/737,434

(22) PCT Filed: May 28, 2009

(86) PCT No.: PCT/JP2009/059783

§ 371 (c)(1),
(2), (4) Date: Jan. 13, 2011

(87) PCT Pub. No.: WO2010/007831

PCT Pub. Date: Jan. 21, 2010

(65) Prior Publication Data

US 2011/0108401 A1 May 12, 2011

(30) Foreign Application Priority Data

Jul. 14, 2008 (JP) ..... 2008-183063

(51) Int. Cl.
*H01H 9/04* (2006.01)

(52) U.S. Cl.
USPC ..... 200/302.1

(58) Field of Classification Search
USPC ..... 29/622; 200/5 A, 512, 517, 302.1, 200/302.2, 341–345; 341/22; 345/168, 169; 400/490–496
See application file for complete search history.

(56) References Cited

U.S. PATENT DOCUMENTS

| | | | | | |
|---|---|---|---|---|---|
| 4,396,830 | A * | 8/1983 | Isozaki et al. | ..... | 235/145 R |
| 5,721,666 | A * | 2/1998 | Girard | ..... | 361/627 |
| 6,043,441 | A * | 3/2000 | Hashida | ..... | 200/512 |
| 6,180,896 | B1 * | 1/2001 | Naritomi | ..... | 200/5 A |
| 6,597,273 | B2 | 7/2003 | Takeda | | |
| 6,683,264 | B2 * | 1/2004 | Obara et al. | ..... | 200/344 |
| 6,971,807 | B2 * | 12/2005 | Tsai et al. | ..... | 400/472 |
| 2002/0093436 | A1 | 7/2002 | Lien | | |
| 2004/0020031 | A1 * | 2/2004 | Lu | ..... | 29/622 |
| 2004/0056077 | A1 | 3/2004 | Ito | | |
| 2007/0199804 | A1 * | 8/2007 | Joseph et al. | ..... | 200/5 A |

FOREIGN PATENT DOCUMENTS

| | | | | |
|---|---|---|---|---|
| CN | 1328332 | A | | 12/2001 |
| CN | 201036198 | Y | | 3/2008 |
| JP | 03020920 | A | * | 1/1991 |
| JP | 10-314492 | A | | 12/1998 |
| JP | 11249789 | A | * | 9/1999 |
| JP | 2001-229764 | A | | 8/2001 |
| JP | 2002-216575 | A | | 8/2002 |
| JP | 2002-216576 | A | | 8/2002 |
| JP | 2006033203 | A | * | 2/2006 |
| TW | 470190 | | | 12/2001 |
| WO | WO-02-060675 | A | | 8/2002 |

* cited by examiner

*Primary Examiner* — Edwin A. Leon
(74) *Attorney, Agent, or Firm* — Rabin & Berdo, P.C.

(57) ABSTRACT

A key switch structure is provided whose waterproofing property is improved without affecting a contact of a membrane sheet. The upper surfaces of the membrane sheet, the embossed part and the circumferential bend part of a back plate are formed on one and the same plane, and a thermal sheet is welded to those upper surfaces. The thermal sheet comprises a thermally meltable, adhesive sheet, which will be heated and pressed with heat rollers to be welded to the upper surfaces. The back plate has an air vent hole formed in its bottom portion.

7 Claims, 5 Drawing Sheets

KEY SWITCH STRUCTURE

TECHNICAL FIELD

The present invention relates to a key switch structure for a keyboard used as an input device in information processing equipment, measuring instruments, medical instruments, etc., and a method of manufacturing the same.

BACKGROUND ART

Conventionally, a keyboard for use in a portable personal computer or the like is so arranged that a key top descends without declining whenever the key top is depressed at any part thereof to ensure so-called smooth operation. For this reason, the conventional key switch structure has its link mechanism provided under the key top. Such a key switch having its link mechanism provided under the key top is disclosed for example in Japanese patent laid-open publication No. 2001-229764.

This key switch 200 has, as shown in FIG. 13, its link mechanism constituted of link members 202 and 204 fixed to the base part 208 of the keyboard with a holder 206. The base part 208 is constituted of a back plate 210 and a membrane sheet 212, on which the holder 206 is arranged. On the back plate 210 there is protrusively formed an embossed part 214 which is fitted in a through hole 216 penetrating the membrane sheet 212. The embossed part has a hole 218, in which there is fitted a welding pin 220 formed in the lower part of the holder 206. The back plate 210 and the holder 206 are adhered to each other having the membrane sheet 212 therebetween.

The membrane sheet is constituted of a plurality of layers 220, 222 and 224 and has a contact 226 of the key switch 200 between the layers. The layers 220, 222 and 224 cannot provide sufficient area for gluing them due to reduction in thickness and size of the keyboard, and thus, they are not sufficiently glued to each other. Consequently, in the conventional key switch structure, when the keyboard left for a long time after liquid has been spilt thereon, the liquid may enter a spot shown with an arrow 228 in FIG. 13, i.e. between the embossed part 214 and the membrane sheet 212 and further enter the contact 226 from the glued part of the membrane sheet 212.

Further, in Japanese patent laid-open publication No. 2002-216575, there is disclosed a device having a waterproofing property in preparation for the case where an operator inadvertently spills liquid on a keyboard during key switch manipulation. This keyboard device has a waterproof sheet over the membrane sheet, which covers the entire keys and is formed so that each key has a waterproof wall therearound, thereby preventing its electronics substrate and others in the lower part of the keyboard from being affected by liquid which is inadvertently spilt on the surface of the keyboard.

However, in the case of thin or small-sized keyboard, it is difficult to form a waterproof sheet in such a particular form, i.e. to form a resin film or other materials to provide a waterproof wall for each key. Moreover, a waterproof sheet thus formed is likely to be made so thick that the operator receives a repulsive force of the sheet when he or she depresses the key switch. Therefore, it takes time since the operator starts depressing the key top until the contact of the key switch is closed.

SUMMARY OF THE INVENTION

In view of overcoming the above-described problems in the prior art, it is an object of the present invention to provide a key switch structure excellent in waterproofing property and a method of manufacturing such a key switch structure.

The present invention relates to a key switch structure, in which a key top is depressed to close a contact provided in a membrane sheet, and which is characterized by comprising a thermally weldable waterproof sheet arranged over the membrane sheet, and a back plate member arranged under the membrane sheet, the back plate member having a fixing embossed part and an outer circumference part that protrude toward the waterproof sheet, the waterproof sheet being thermally welded to the upper surfaces of the membrane sheet, the embossed part and the outer circumference part.

According to the present invention, it is possible to enhance the waterproofing property of the membrane sheet without affecting operation of the key switch so as to prevent liquid, whenever spilt on the keyboard, from getting into the membrane sheet layers.

Further, there is no need to form a waterproof sheet in a particular form, so that it is possible to make the waterproof sheet thinner.

Furthermore, according to the present invention, there is no need to glue a plurality of membrane sheet layers to each other, and thus it is possible to overcome the difficulty in establishing a sufficient gluing area of the membrane sheet.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Figure 1:
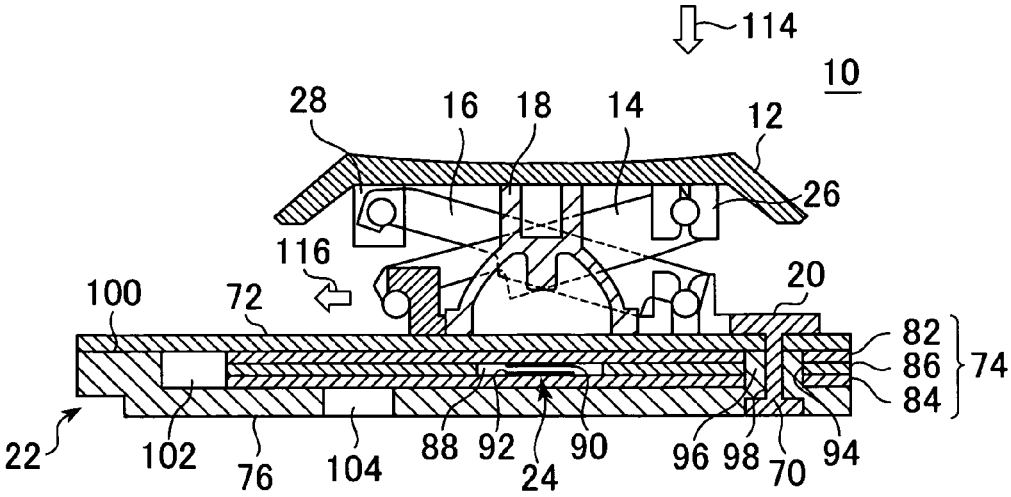
FIG. 1 is a schematic cross-sectional view showing the main part of a key switch in accordance of an embodiment of the present invention.

In the following, an embodiment of a key switch structure in accordance with the present invention will be described in detail with reference to the appended drawings. A key switch 10 in accordance with the embodiment comprises a key top 12, link members 14 and 16, an elastic member 18, a holder 20 and a base part 22, as shown in FIG. 1, so as to allow a contact 24 arranged in the base part 22 to close in response to the key top 12 being depressed.

Figure 2:
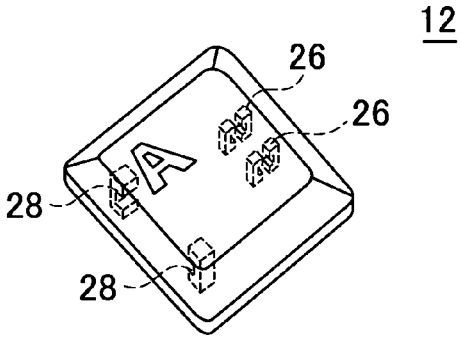
FIG. 2 is a schematic perspective view showing a key top in the embodiment of FIG. 1.

On the surface, or upper face, of the key top 12, there may be letters or symbols printed. On the rear side of the key top 12, as shown in FIG. 2, there are provided a rotation support 26 for rotatably supporting one end of the link member 14, and a slide support 28 for supporting one end of the link member 16 rotatably and movably in a horizontal direction.

The link members 14 and 16 are rotatably connected to each other at their respective central parts, and have one end thereof supported by the key top and the other end supported by the holder 20.

Figure 3:
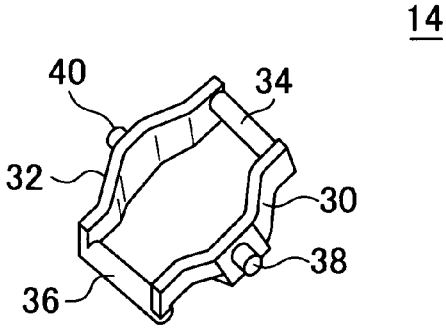
FIG. 3 is a schematic perspective view showing a link member in the embodiment of FIG. 1.

More specifically, the link member 14 comprises a pair of leg parts 30 and 32, as shown in FIG. 3. The leg parts have one end connected with a connecting rod 34 to each other and the other end connected with a connecting rod 36 to each other. The connecting rod 34 is inserted into and supported by the rotation support 26 of the key top, while the connecting rod 36 is supported by the holder 20. The link member 14 comprises shafts 38 and 40 at the central parts on the outer surfaces of the leg parts 30 and 32, respectively, by means of which the link member 14 is connected to the link member 16. In the embodiment, the shafts 38 and 40 are located on the outer surfaces of the leg parts 30 and 32, respectively, on the lines, each of which connects the connecting rods 34 and 36, at an equal distance from the connecting rods 34 and 36.

Figure 4:
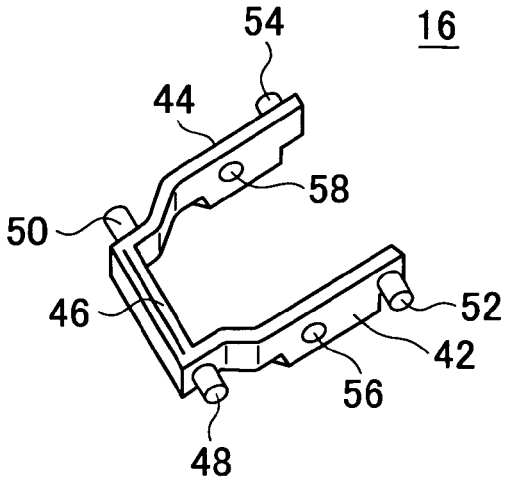
FIG. 4 is a schematic perspective view showing another link member in the embodiment of FIG. 1.

Further, the link member 16 comprises, as shown in FIG. 4, a pair of legs 42 and 44 which have one end connected with a connecting rod 46 to each other. Each of the ends is provided outwardly with supporting protrusion 48 or 50, which is supported by the slide support 28 of the key top. The leg parts 42 and 44 have the other end thereof provided outwardly with supporting protrusions 52 and 54, respectively, which are supported by the holder 20. Distances between the supporting protrusions 48 and 52 and between the supporting protrusions 50 and 54 are equal to the distance between the connecting rods 34 and 36 of the link member 14. Moreover, in the embodiment, the connecting rod 46 is provided on the tip ahead of the supporting protrusions 48 and 50 in the link member 16.

Furthermore, the link member 16 comprises shaft holes 56 and 58 in the leg parts 42 and 44, respectively, to rotatably support the shafts 38 and 40 of the link member 14. In the embodiment, the shaft holes 56 and 58 are respectively located on the outer surfaces of the leg parts 42 and 44 on the lines, which respectively connect the supporting protrusions 48 and 52 to each other and the supporting protrusions 50 and 54 to each other, at respective, equal distances from the supporting protrusions 48 and 52 and from the supporting protrusions 50 and 54.

Figure 5:
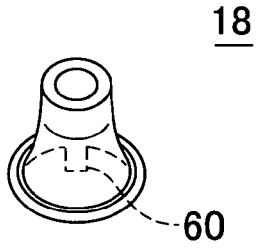
FIG. 5 is a schematic perspective view showing an elastic member in the embodiment of FIG. 1.

The elastic member 18 is arranged under the key top 12 to support the key top 12. The elastic member 18 bends when the key top is depressed, while it restores the key top 12 to its original position when the depressing force applied on the key top 12 is removed. The elastic member 18 in the embodiment is, as shown in FIG. 5, formed generally in a cup-like shape of material, such as rubber, and has its inner surface, in the central part of which a contact depressing part 60 is protrusively provided. The elastic member 18 is arranged on the base part 22 in such a way that the contact depressing part 60 opposes the base part 22 and is located immediately above the contact 24 of the base part 22. Accordingly, when the key top 12 is depressed, the contact depressing part 60 can push the contact 24 to close the switch.

Figure 6:
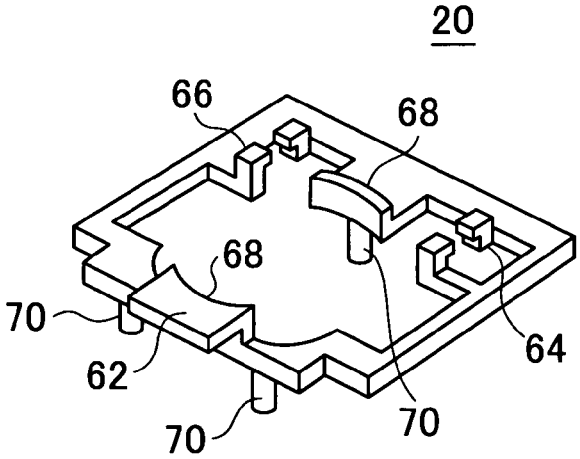
FIG. 6 is a schematic perspective view showing a holder in the embodiment of FIG. 1.

The holder 20 in the embodiment is, as shown in FIG. 6, formed in a frame-like shape individually for each key switch 10, and arranged on the base part 22. The holder 20 comprises, in the vicinity of its one end, a slide guide 62 for supporting the connecting rod 36 of the link member rotatably and movably in the horizontal direction, and in the vicinity of the other end rotation guides 64 and 66 for rotatably supporting the supporting protrusions 52 and 54 of the link member 16. The holder 20 comprises in the central part of its both ends arch-shaped guide walls 68, which oppose each other and fix the outer circumference of the elastic member 18. Further, the holder 20 has its lower surface provided with welding pins 70 having a predetermined length, and is fixed on the base part 22 by the welding pins 70.

The base part 22 includes a thermal sheet 72, a membrane sheet 74 and a back plate 76, the membrane sheet 74 being disposed between the thermal sheet 72 and the back plate 76.

Figure 7:
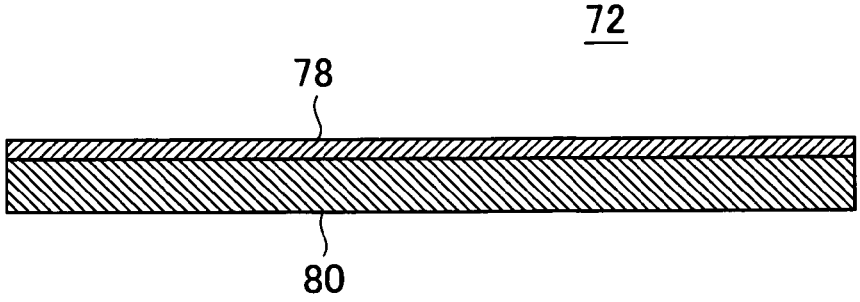
FIG. 7 is a schematic cross-sectional view showing a thermal sheet in the embodiment of FIG. 1.

The thermal sheet 72 is waterproof, and comprises, as shown in FIG. 7, a thin membrane layer 78 excellent in waterproofing property as its upper layer and a thermally melting adhesive layer 80 as its lower layer. The thin membrane layer 78 in the embodiment is a PET (polyethylene therephthalate) sheet of 25 μm thick. The thermal sheet is arranged to cover the entire membrane sheet 74.

Figure 8:
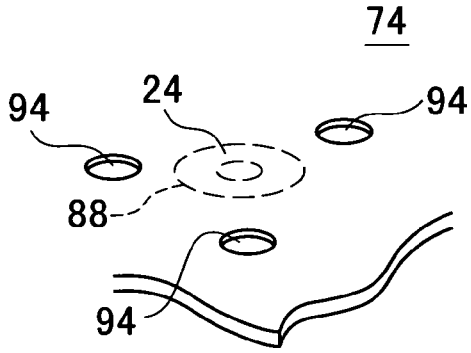
FIG. 8 is a schematic perspective view showing a membrane sheet in the embodiment of FIG. 1.

The membrane sheet 74 includes, as shown in FIG. 1, an upper layer 82 and a lower layer 84 both of which have elasticity, and a spacer layer 86 interposed between the sheets 82 and 84. The spacer layer 86 has through holes 88 cut, of which the positions correspond to the positions of the contacts 24. Each through hole 88 forms a space between the upper and lower layers 82 and 84, in which space a movable contact piece 90 is provided on the upper layer 82 and a fixed contact piece 92 on the lower layer 84 so as to oppose each other. The contact pieces 90 and 92 constitute the contact 24 of the key switch. The membrane sheet 74 has, as shown in FIG. 8, a plurality of through holes 94 cut around each through hole 88.

Figure 9:
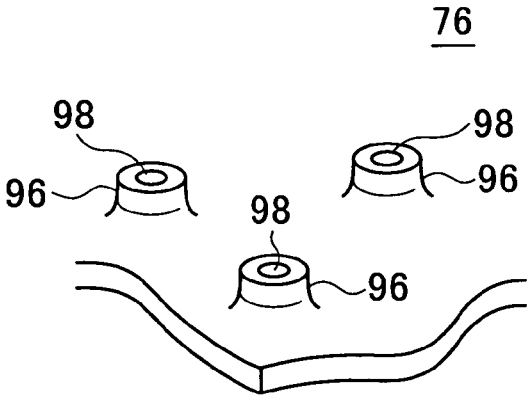
FIG. 9 is a schematic perspective view showing a back plate in the embodiment of FIG. 1.

The back plate 76 comprises, as shown in FIG. 9, a plurality of embossed parts 96. The embossed parts 96 are provided at the positions corresponding to the through holes 94 of the membrane sheet 74 to be fitted in the through holes 94. The embossed part 96 has its height approximately equal to the thickness of the membrane sheet 74. The part 96 has a hole 98 penetrating therethrough in the direction of its height and intended to fit a welding pin 70 of the holder 20 thereinto. Accordingly, in the embodiment, the welding pins 70 of the holder 20 are provided at the positions corresponding to the holes 98 of the embossed parts 96. Further, the back plate 76 is, as shown in FIG. 1, formed in a bath tub shape having its outer circumference part 100 whose upper surface is leveled on the same plane as the upper surfaces of the embossed parts 96.

In the base part 22 of the embodiment, as shown in FIG. 1, the upper surface of the membrane sheet 74, and the upper surfaces of the embossed parts 96 and the outer circumference part 100 of the back plate 76 are leveled on the same plane, and are securely adhered to the thermal sheet 72.

The base part 22 in the embodiment has, as shown in FIG. 1, a space 102 enclosed by the membrane sheet 74, the outer circumference part 100 of the back plate and the thermal sheet 72. Since the back plate 76 is provided with an air vent hole 104, the space 102 is not tightly sealed.

Now, a method of manufacturing the base part 22 will be described. To begin with, the membrane sheet 74 is placed on the back plate 76 in such a way that the respective embossed parts 96 of the back plate 76 are fitted in the through holes 94 of the membrane sheet 74. Then, it is further covered with the thermal sheet 72. At this stage, the thermal sheet 72, the membrane sheet 74 and the back plate 76 have not yet been adhered to each other.

Figure 10:
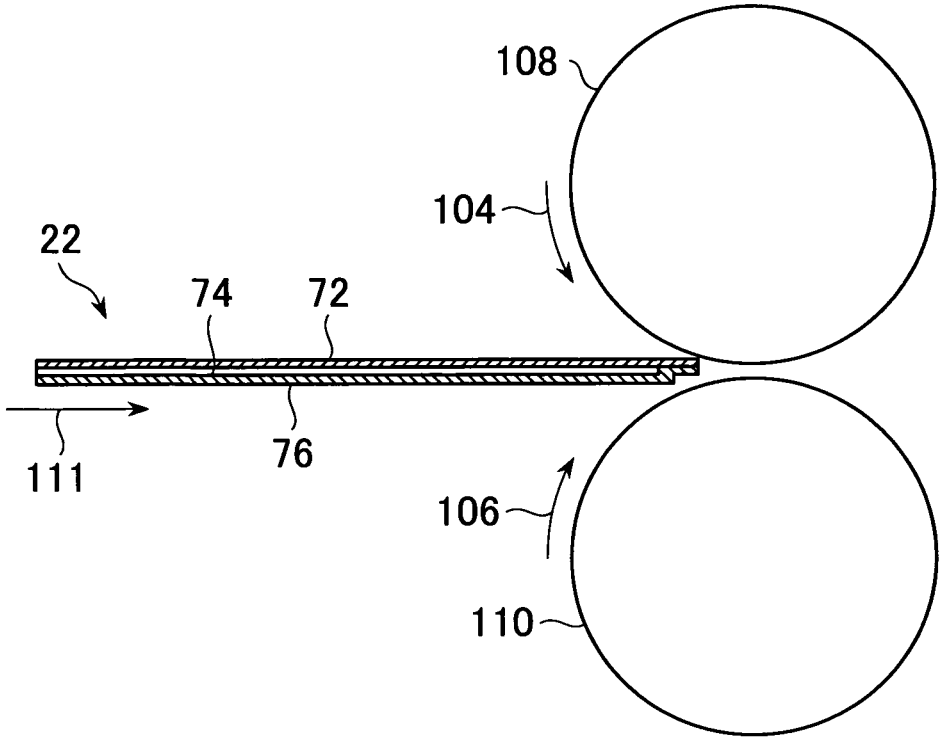
FIG. 10 shows how to manufacture a base part in the embodiment of FIG. 1.

Subsequently, as shown in FIG. 10, the thermal sheet 72, the membrane sheet 74 and the back plate 76 are fed in the direction of an arrow 111 between a couple of heating rollers 108 and 110 having heat sources inside and rotating in the directions of respective arrows 104 and 106 so as to be subjected to high temperature and pressure. The adhesive layer 80 of the thermal sheet is melted with the heat of the heating rollers, and the thermal sheet 72 is securely adhered onto the upper surface of the membrane sheet 74, and the upper surfaces of the embossed parts 96 and the outer circumference part 100 of the back plate by means of the pressure from the heating rollers. Thus, the base part 22 having the thermal sheet 72, the membrane sheet 74 and the back plate 76 integrally fixed to each other will be obtained.

Figure 11:
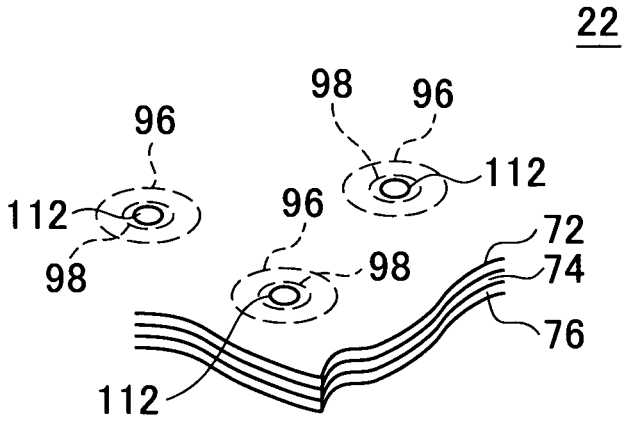
FIG. 11 is a schematic perspective view showing the base part in the embodiment of FIG. 1.
Figure 12:
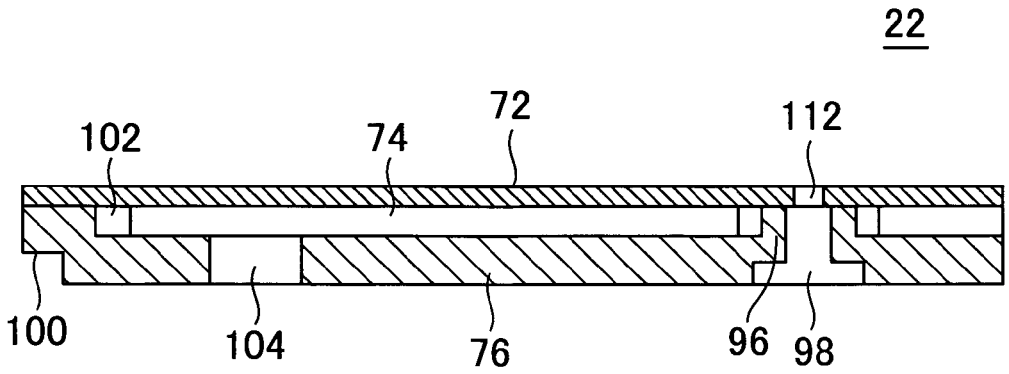
FIG. 12 is a schematic cross-sectional view showing the base part in the embodiment of FIG. 1.
Figure 13:
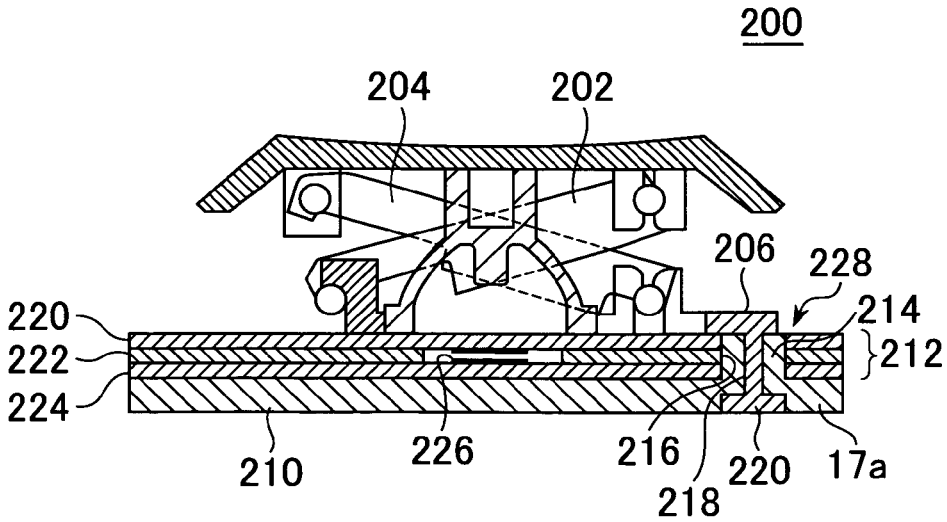
FIG. 13 is a cross-sectional view showing a conventional key switch structure.

In the following, a method of assembling the key switch 10 in accordance with the embodiment will be described. Firstly, as shown in FIGS. 11 and 12, through the upper portion of the base part 22 thus obtained in the above-described method there are formed pin holes 112. The pin holes 112 are provided in the positions corresponding to the holes 98 of the embossed parts of the back plate, and are smaller in diameter than the holes 98. Then, the welding pins 70 of the holder 20 are pressed into the pin holes 112 of the base part and further inserted into the holes 98 of the embossed parts to be thermally welded. The apical ends of the welding pins 70 are heated to be deformed into flat shape and tightly fixed on the base part 22, as shown in FIG. 1. Thereby, the holder 20 and the back plate 76 hold the thermal sheet 72 and the membrane sheet 74 therebetween.

Subsequently, the operation of the key switch will be described. When the key top 12 is depressed from above with an optional load, the key top 12 moves downward. At this instance, the elastic member 18 deforms itself to render its contact depressing part 60 depress the contact 24 of the membrane sheet 74 via the thermal sheet 72, whereby the switch is in its closure state. The depression of the contact 24 brings the membrane sheet 74 to its deformation to purge the air in the space 102 of the base part 22 through the air vent hole 104, wherefore the thermal sheet 72 and the membrane sheet 74 can be deformed well at the portion of the contact 24. In the embodiment, the air vent hole 104 is located beneath the membrane sheet 74 in the base part 22.

In the key switch 10 of the embodiment, whenever the key top 12 be depressed at its edge, the key top 12 can descend with its horizontal orientation maintained by means of the link mechanism constituted of the link members 14 and 16. For example, when the key top is depressed at its edge shown with the arrow 114 in FIG. 1, that end of the link member 14 on the side of the arrow 114 first descends. The other end of the link member 14 moves in the direction of an arrow 116. The central part of the link member 14 thereby descends to render the link member 16 linked with the link member 14 at its central part also descend. As a result, the key top 12 can keep its horizontal orientation while descending.

According to the embodiment, the thermal sheet 72 is thermally welded to the upper surface of the membrane sheet 74, and the upper surfaces of the embossed parts 96 and the circumferential bend part 100 of the back plate 76, and therefore, whenever liquid, such as water, is spilt on the keyboard, the liquid does not get into the membrane sheet layers 74.

According to the embodiment, since the welding pins 70 of the holder 20 are pressed into the pin holes 112 of the base part 22, liquid spilt on the thermal sheet does not get into the membrane sheet layers 74 through the pin holes 112. Even if liquid should get into the pin hole 112, the liquid would not get into the membrane sheet layers 74 since the waterproof thermal sheet 72 is thermally welded to the upper surfaces of the embossed parts 96 of the back plate 76.

According to the embodiment, since the upper surface of the membrane sheet 74, and the upper surfaces of the embossed parts 96 and the circumferential bent part 100 of the back plate 76 are leveled on the same plane, there is no need of forming the thermal sheet 72 in a particular shape, which can contribute to the cost-reduction of the apparatus. Further, as the thermal sheet 72 can be thinner, the thickness of the thermal sheet 72 would not have an effect on the manipulation of the key switch 10.

Furthermore, according to the embodiment, since the base part 22 has the air vent hole 104 formed in its bottom portion, the thermal sheet 72 and the membrane sheet 74 can bend well when the key top is depressed. Further, since the thermal sheet 72 is welded on the membrane sheet 74 and the back plate 76 under high pressure and temperature, there is no need of gluing the membrane sheet 74, whereby making it possible to avoid the problem arising from providing a sufficient gluing area of the membrane sheet 74.

Still further, in the key switch 10 of the embodiment, whenever the key top 12 is depressed at any portion, the key top keeps its horizontal orientation while moving downward, and thus there is no difference in manipulation feeling between portions at which the key top is depressed, i.e. operability can be secured.

The entire disclosure of Japanese patent application No. 2008-183063 filed on Jul. 14, 2008, including the specification, claims, accompanying drawings and abstract of the disclosure, is incorporated herein by reference in its entirety.

While the present invention has been described with reference to the particular illustrative embodiment, it is not to be restricted by the embodiment. It is to be appreciated that those skilled in the art can change or modify the embodiment without departing from the scope and spirit of the present invention.

The invention claimed is:

1. A key switch structure for closing a contact provided in a membrane sheet in response to a key top being depressed, comprising:

a thermally weldable waterproof sheet disposed over said membrane sheet, said membrane sheet having a through hole cut therein; and a back plate member disposed under said membrane sheet, said back plate member having an outer circumference part protruding toward said waterproof sheet and a fixing embossed part protruding toward said waterproof sheet and disposed at a position corresponding to the through hole to be fitted in the through hole;

said waterproof sheet being thermally welded to an upper surface of said membrane sheet, an upper surface of said embossed part and an upper surface of said outer circumference part.

2. The key switch structure in accordance with claim 1, wherein the upper surface of said membrane sheet, the upper surface of said embossed part and the upper surface of said outer circumference part are located on a same plane.

3. The key switch structure in accordance with claim 1, wherein said back plate member has an air vent hole formed in a position opposing said membrane sheet.

4. A method for manufacturing a key switch structure for closing a contact provided in a membrane sheet in response to a key top being depressed, comprising:

forming a base part constituted of a thermally weldable waterproof sheet disposed over the membrane sheet and a back plate member, disposed under the membrane sheet and having a fixing embossed part protruding toward the waterproof sheet and an outer circumference part protruding toward the waterproof sheet, with the embossed part being fitted into a through hole cut in the membrane sheet and with the waterproof sheet opposing an upper surface of the membrane sheet, an upper surface of the embossed sheet and an upper surface of the outer circumference part; and heating the base part so that the waterproof sheet is thermally welded to the upper surface of the membrane sheet, the upper surface of the embossed part and the upper surface of the outer circumference part.

5. The method in accordance with claim 4, further comprising pressing a welding pin of a holder into the embossed part of the base part to which the waterproof sheet has been thermally welded.

6. The key switch structure in accordance with claim 1, wherein said membrane sheet has an additional through hole cut therein, said back plate member having an additional fixing embossed part protruding toward said waterproof sheet and disposed at a position corresponding to the additional through hole, the through holes being arranged around a position corresponding to the contact.

7. The method in accordance with claim 4, wherein the membrane sheet has an additional through hole cut therein, the back plate member having an additional fixing embossed part protruding toward the waterproof sheet and disposed at a position corresponding to the additional through hole, the through holes being arranged around a position corresponding to the contact.

* * * * *